US005823583A

United States Patent [19]

Sandhu et al.

[11] Patent Number: 5,823,583

[45] Date of Patent: Oct. 20, 1998

[54] LATCH MECHANISM FOR GLOVE BOX DOOR

[75] Inventors: Chain Sandhu, Farmington Hills; Lev Lilov, West Bloomfield, both of Mich.

[73] Assignee: NYX, Inc., Livonia, Mich.

[21] Appl. No.: 581,161

[22] Filed: Dec. 29, 1995

[51] Int. Cl.[6] ..... E05C 1/12

[52] U.S. Cl. ..... 292/173; 292/165; 292/DIG. 31

[58] Field of Search ..... 292/175, 173, 292/DIG. 38, DIG. 31, DIG. 64, 169, 165

[56] References Cited

U.S. PATENT DOCUMENTS

| | | | |
|---|---|---|---|
| 3,743,336 | 7/1973 | Andrews . | |
| 4,116,027 | 9/1978 | Tannery . | |
| 4,223,940 | 9/1980 | Janz et al. | 292/DIG. 37 X |
| 4,534,193 | 8/1985 | Takemura et al. | 70/218 |
| 4,580,822 | 4/1986 | Fukumoto | 292/336.3 |
| 5,098,141 | 3/1992 | Bull . | |
| 5,263,346 | 11/1993 | Sato et al. . | |
| 5,292,159 | 3/1994 | Sandhu et al. . | |
| 5,297,405 | 3/1994 | Manning et al. | 70/208 |
| 5,551,737 | 9/1996 | Clavin | 292/169 |

*Primary Examiner*—Rodney M. Lindsey
*Attorney, Agent, or Firm*—Brooks & Kushman P.C.

[57] ABSTRACT

A glove box door latching assembly comprises a latching mechanism including three plastic molded parts and a spring. The mechanism includes an offset latch member which allows positioning of the mechanism closely adjacent a longitudinal end of a glove box door. The assembly also includes a lock tube formed integrally therewith for receiving a locking mechanism. The lock tube is flush with the front face of the mechanism to allow the lock tube to be covered by the glove box door if the locking feature is not desired. The universal latch assembly design is widely applicable to various glove box door assemblies.

17 Claims, 2 Drawing Sheets

LATCH MECHANISM FOR GLOVE BOX DOOR

TECHNICAL FIELD

The present invention relates to an improved vehicle glove box door latch mechanism for use in different locations on the glove box and with or without a lock.

BACKGROUND OF THE INVENTION

Traditionally, vehicle glove box door latching mechanisms are complex multi-component devices which are narrowly designed to satisfy the requirements of specific vehicle applications.

Conventional vehicle glove box door latching devices, such as those disclosed in U.S. Pat. Nos. 5,098,141 and 5,263,346 comprise a complex design with a large number of latching components which result in undesirable design complexity and high manufacturing costs. The large number of components increases the risk of part failure. Furthermore, such latching device assemblies are limited in their flexibility of application due to their design complexity, and their design does not allow placement of the latch closely adjacent a longitudinal end of a glove box door.

Also, most latching mechanisms have the latch bolt centrally mounted on the body of the device, which prevents placement of the latch closely adjacent a longitudinal end of a glove box door because the body interferes with such placement.

Furthermore, known glove box latch assemblies require the entire mechanism to match the color of the glove box door for aesthetic purposes, rather than merely requiring the handle to match the glove box door. This color requirement adds to manufacturing costs because each component of the mechanism must be either molded in color or painted.

Accordingly, it is desirable to provide a vehicle glove box latching mechanism which is simple in design and universal in its application. It is further desirable to provide a latching mechanism which is adaptable for attachment to various locations on a glove box door, including positioning closely adjacent longitudinal ends of the door. It is also desirable to provide a latching mechanism design which requires only the handle to match the color of the glove box door.

DISCLOSURE OF THE INVENTION

The present invention overcomes the above referenced problems experienced by prior art glove box door latching assemblies by providing a latching mechanism which comprises only three plastic molded parts and a spring. The mechanism includes an offset latch member which allows positioning of the mechanism closely adjacent a longitudinal end of a glove box door. The assembly also includes a lock tube formed integrally therewith for receiving a locking mechanism. The lock tube is flush with the front face of the mechanism to allow the lock tube to merely be covered by the glove box door if the locking feature is not desired. The assembly is universal in design in that it is widely applicable to various glove box door assemblies. In addition, only the handle is required to match the color of the glove box door, thus reducing manufacturing costs.

The latch mechanism of the present invention is distinguished by three plastic molded parts which cooperatively assemble and function in moving "plastic on plastic" relation to form a simplified, but effective latch assembly. The assembly also includes a spring associated with the latch bolt to urge it to an engaging position. The assembly comprises four pieces. First, a mounting plate is configured to be received by a glove box door. Second, a latch bolt reciprocates between an engaged position and a released position. Third, a compression spring has one end which reacts against the mounting plate and another end which urges the latch bolt to the engaged position. Fourth, an actuator is pivotable between the engaged and released positions to move the latch bolt between its respective positions. The actuator is pivotally coupled to the mounting plate. The latch mechanism may be secured to a glove box door by one or two screws, and the mounting plate can be molded to integrally provide a lock tube for a lock cylinder. The latch bolt is offset from center to allow assembly of the mechanism closely adjacent a longitudinal end of a glove box door.

More specifically, the present invention provides a latch mechanism for securing a vehicle glove box door in a flush position relative to an adjoining panel surface, the door having first and second longitudinal ends. The latch mechanism comprises a body having first and second longitudinal ends, and forming a transverse channel through the body closely adjacent one of the ends of the body. The body further includes a plurality of mounting flanges positioned for attachment to the door. A latch member is slidably disposed in the channel. A handle is pivotally mounted on the body for movement between the latched and unlatched positions. The handle includes an axle member extending longitudinally with respect to the body, and the handle includes a lever arm extending radially outward from the axle member for engagement with the latch member. A spring is positioned with respect to the handle and the body for biasing the handle toward the latched position. The offset configuration of the latch member facilitates positioning of the latch mechanism closely adjacent one of the longitudinal ends of the door.

Accordingly, an object of the present invention is to provide a new latch mechanism which is economical to produce and which possesses improved operational features.

Another object of the present invention is to provide a glove box latching mechanism which is simple in design and universal in application, and includes an offset latch member in order to accommodate attachment of the latch mechanism at virtually any location on the glove box door.

A further object of the present invention is to provide a latch mechanism which includes an integral lock tube for receiving a locking mechanism, the lock tube being flush with the front face of the mechanism in order to allow easy deletion of the lock mechanism by covering the lock tube with a glove box door.

A more specific object of the present invention is to provide a latch mechanism for securing a vehicle glove box door in a flush position relative to an adjoining panel surface, the door having first and second longitudinal ends. The latch mechanism comprises a body having first and second longitudinal ends, and forming a transverse channel through the body closely adjacent one of the ends of the body. The body further includes a mounting flange positioned for attachment to the door and a pair of receiving apertures formed thereon at the longitudinal ends of the body. A latch member is slidably disposed in the channel and forms a slot therein. A handle is pivotally mounted on the body and includes an axle member extending longitudinally with respect to the body and engageable with the receiving apertures. The handle further includes a lever arm extending radially outward from the axle member for engagement within the latch member slot. A spring is positioned with respect to the handle and the body for biasing the handle toward a latched position. The body further includes a lock tube formed integrally therewith adjacent the channel to facilitate locking of the latch mechanism. The lock tube is disposed flush with the handle whereby to allow the lock tube to be disposed in the hidden position behind the door when the lock tube is not required. The handle is aesthetically comparable in color to the glove box door, whereby to reduce manufacturing costs.

Other objects, features and advantages of the present invention will become apparent from the subsequent description and the appended claims taken in conjunction with the accompanying drawings.

DETAILED DESCRIPTION OF THE PREFERRED EMBODIMENT

Figure 1:
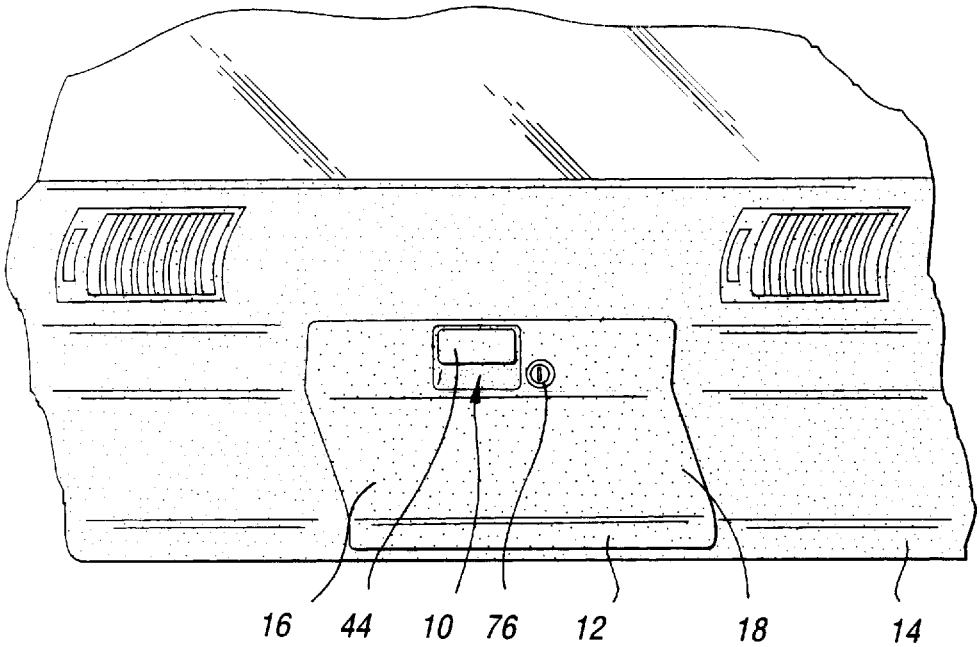
FIG. 1 shows a latch mechanism installed in a vehicle glove box door in accordance with the present invention.

FIG. 1 shows a latching mechanism 10 assembled in a glove box door 12 of a vehicle instrument panel 14. The latching mechanism 10 of the present invention is universal in application as a result of its design simplicity, flush lock cylinder, and offset latch. The offset latch allows the latching mechanism 10 to be attached closely adjacent longitudinal ends 16,18 of the glove box door 12.

Figure 2:
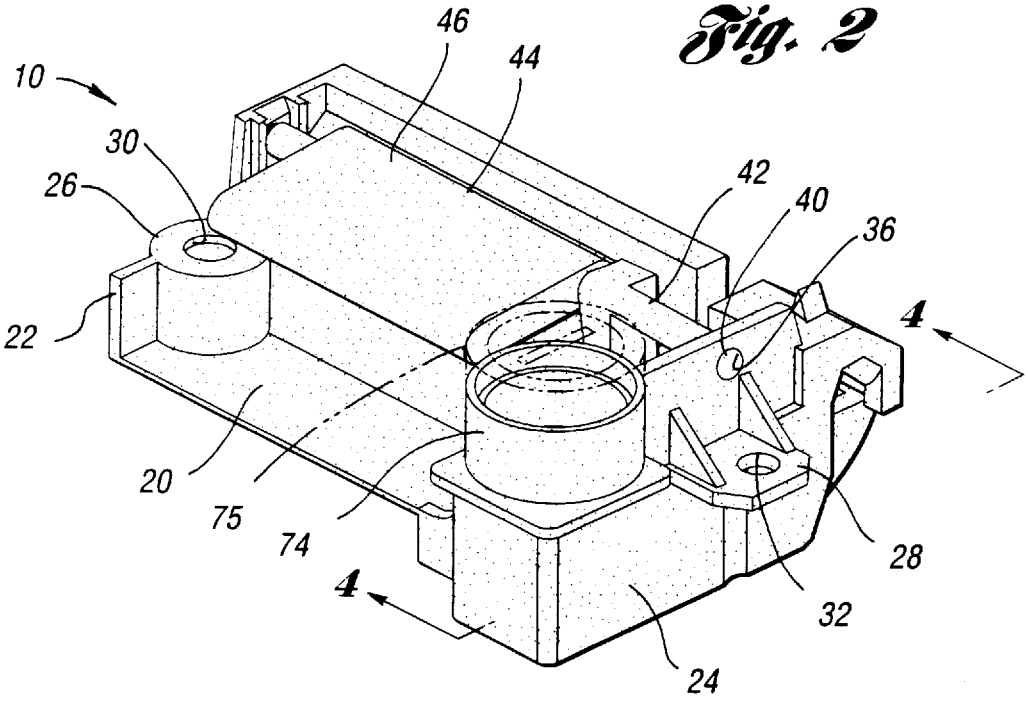
FIG. 2 shows a perspective view of a latch mechanism in accordance with the present invention.
Figure 3:
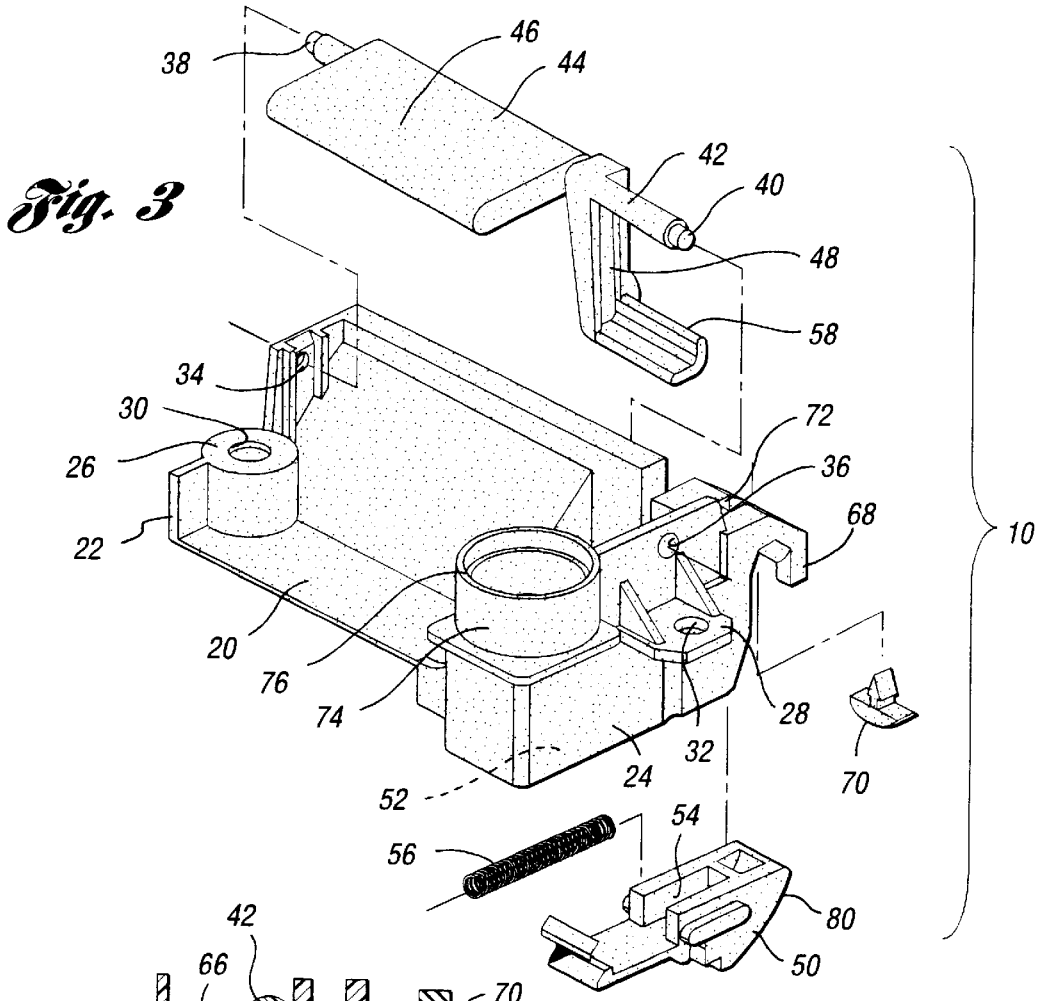
FIG. 3 shows an exploded perspective view of a latch mechanism in accordance with the present invention.

The latching mechanism 10 is more clearly shown in FIGS. 2 and 3. The latching mechanism 10 includes a body 20 having first and second longitudinal ends 22,24 respectively. The body 20 includes a pair of mounting flanges 26,28 having apertures 30,32 formed therethrough for receiving mounting screws which mount the mechanism 10 to the glove box door 12.

A handle 44 is provided for unlatching the mechanism 10. The handle 44 includes an axle member 42 which extends longitudinally with respect to the body 20, and is engageable within the receiving apertures 34,36 formed in the body for pivotally mounting the handle 44 to the body 20. The handle 34 further includes a front face 46 which is preferably disposed flush with the glove box door 12 in the final assembly.

The handle 44 also includes a lever arm 48 extending radially therefrom for engagement with the latch 50. As the handle 44 is pivoted about the axle member 42, the lever arm 48 rotates, which causes the latch 50 to reciprocate, thereby engaging or disengaging a glove box door component to lock or unlock the door 12.

The latch 50 is slidably disposed in a channel 52 formed along a longitudinal end 24 of the body 20. The latch 50 forms a slot 54 for receiving the spring 56. The spring 56 biases the latch 50 toward the latched position shown in FIG. 4.

Figure 4:
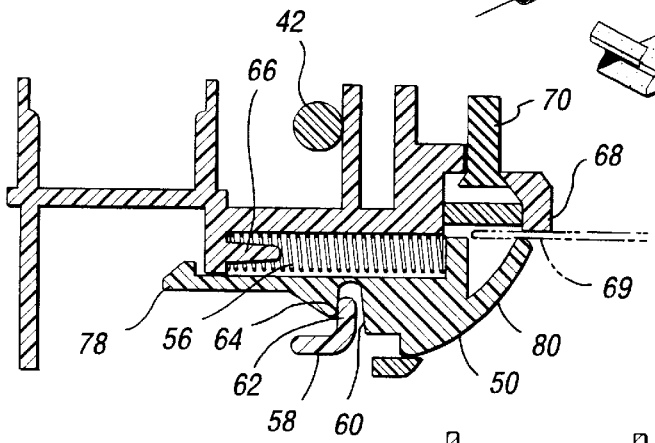
FIG. 4 shows a sectional view taken through line 4—4 of FIG. 2 with the mechanism in the latched position.
Figure 5:
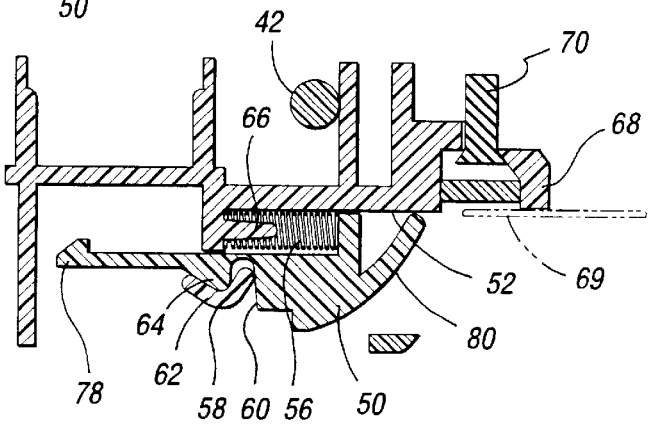
FIG. 5 shows a sectional view taken through line 4—4 of FIG. 2 with the mechanism in the unlatched position.

The lever arm 48 of the handle 44 includes a leg 58 with an L-shaped cross-section. The leg 58 extends longitudinally along the body 20 for engagement within a slot 60 formed in the latch 50. With the latch mechanism 10 in the latched position as shown in FIG. 4, an end portion 62 of the L-shaped leg 58 is disposed within the slot 60 of the latch 50.

The latch 50 includes a curved front surface 80 to facilitate closing of the glove box door 12. When the glove box door 12 is pivoted toward the instrument panel 14, an instrument panel portion 69 engages the curved front surface 80 of the latch 50, thereby sliding the latch 50 longitudinally within the channel 52 in order to allow the instrument panel portion 69 to be captured by the latch 50 to secure the glove box door 12 in the latched position.

When it is desired to unlatch the mechanism 10, the handle 44 is rotated about the axle member 42 which causes the end portion 62 of the L-shaped leg 58 to push against the cam portion 64 of the latch 50, thereby moving the latch 50 away from the latched position against the force of the spring 56. The spring 56 is secured laterally with respect to the body on a body pin 66 extending along the channel 52.

The latch 50 in combination with a C-shaped body portion 68 forms a latch housing for capturing an instrument panel portion 69 (shown in phantom) in order to secure the door 12 in a flush position with respect to the instrument panel 14. The mechanism 10 may include a rubber stop 70 inserted through an aperture 72 of the latch housing. The stop 70 cushions latching engagement of the mechanism 10 in order to prevent rattles.

The body 20 further includes a lock cylinder 74 formed integrally therewith. The lock cylinder 74 includes a front face 76 which is preferably formed flush with the front face 46 of the handle 44. The lock cylinder 74 is adapted to receive a locking mechanism 75 (shown in phantom in FIG. 2). The locking mechanism would merely extend through the lock cylinder 74 to selectively interfere with sliding movement of the latch 50 within the channel 52. The lock cylinder 74 would include a lock tab which would extend to interfere with the bottom portion 78 of the latch 50 in order to prevent movement of the latch 50 toward the unlatched position. The flush design of the front face 76 of the lock cylinder 74 allows the lock cylinder 74 to be deleted if so desired in assembly by merely providing a glove box door 12 which extends to cover the front face 76 of the lock cylinder 74. This feature enhances the universality of the latching mechanism design.

The "offset" design of the latching mechanism 10 facilitates positioning of the latch mechanism 10 at virtually any position on the glove box door 12. Because the latch 50 travels in a channel 52 which is formed closely adjacent the longitudinal end 24 of the body, the latching mechanism 10 may be installed closely adjacent a longitudinal end 16,18 of the glove box door 12. If the latch 50 were centrally located on the body 20 of the mechanism 10, the longitudinal ends 22,24 of the body 20 would interfere with the instrument panel 14 or glove box bin, thereby preventing placement of the latching mechanism closely adjacent a longitudinal end 16,18 of the door. Of course, the latch 50 could be placed in the opposing longitudinal end 22 of the body 20 for the same reason. This mirror image of the present design could be placed closely adjacent the opposite end of the door 12.

This design only exposes the handle 44 when assembled on a glove box door 12. Therefore, only the handle 44 must match the color of the door 12, thereby reducing manufacturing costs.

While the best mode for carrying out the invention has been described in detail, those familiar with the art to which this invention relates will recognize various alternative designs and embodiments for practicing the invention. Thus, the above described preferred embodiment is intended to be illustrative of the invention which may be modified within the scope of the following appended claims.

What is claimed is:

1. A latch mechanism for securing a vehicle glove box door relative to an adjoining panel surface, said door having first and second longitudinal ends, said latch mechanism comprising:

a body having first and second longitudinal ends, and forming a transverse channel through the body at one of said ends of said body and further having at least one mounting flange positioned for attachment to the door;

a latch member slidably disposed in said channel;

a handle pivotally mounted on said body for movement between latched and unlatched positions, said handle including an axle member extending longitudinally with respect to said body, and said handle further including a lever arm extending radially from said axle member for engagement with said latch member; and a biasing member positioned with respect to said handle and said body for biasing said handle toward the latched position.

2. The latch mechanism of claim 1, further comprising a lock tube formed integrally with said body adjacent said channel to facilitate locking of the latch mechanism.

3. The latch mechanism of claim 1, wherein the latch mechanism comprises no more than three plastic parts and a spring.

4. The latch mechanism of claim 1, wherein said body forming a pair of receiving apertures at said longitudinal ends of said body for receiving said axle member.

5. The latch mechanism of claim 1, wherein each of said mounting flanges forms an aperture therethrough for attachment of said body to the door.

6. The latch mechanism of claim 2, wherein said lock tube being disposed flush with said handle whereby to allow the lock tube to be disposed in a hidden position behind the door if the lock tube is not required.

7. The latch mechanism of claim 1, wherein said latch member forming a slot for engagement with said lever arm.

8. The latch mechanism of claim 2, further comprising a locking mechanism secured within said lock tube for selective locking engagement with said latch member.

9. A latch mechanism for securing a vehicle glove box door relative to an adjoining panel surface, said door having first and second longitudinal ends, said latch mechanism comprising:

a body having first and second longitudinal ends, and forming a transverse channel through the body at one of said ends of said body, and further having at least one mounting flange positioned for attachment to the door;

a latch member slidably disposed in said channel;

a handle pivotally mounted on said body for movement between latched and unlatched positions, said handle including an axle member and a lever arm extending radially from said axle member for engagement with said latch member;

a biasing member positioned on said body for biasing said handle toward the latched position; and a lock tube formed integrally with said body adjacent said channel.

10. The latch mechanism of claim 9, wherein the latch mechanism comprises no more than three plastic parts and a spring.

11. The latch mechanism of claim 9, wherein said body forming a pair of receiving apertures at said longitudinal ends of said body for receiving said axle member.

12. The latch mechanism of claim 9, wherein each of said mounting flanges forms an aperture therethrough for attachment to the door.

13. The latch mechanism of claim 9, wherein said lock tube being disposed flush with said handle whereby to allow the lock tube to be disposed in a hidden position behind the door if the lock tube is not required.

14. The latch mechanism of claim 9, wherein said latch member forming a slot for engagement with said lever arm.

15. The latch mechanism of claim 9, further comprising a locking mechanism secured within said lock tube for selective locking engagement with said latch member.

16. A latch mechanism for securing a vehicle glove box door in a flush position relative to an adjoining panel surface, said door having first and second longitudinal ends, said latch mechanism comprising:

a body having first and second longitudinal ends, and forming a transverse channel through the body at one of said ends of said body, and further having at least one mounting flange positioned for attachment to the door, said body further including a pair of receiving apertures formed thereon at said longitudinal ends of said body;

a latch member slidably disposed in said channel, said latch member forming a slot therein;

a handle pivotally mounted on said body, said handle including an axle member extending longitudinally with respect to said body and engageable within said receiving apertures, and said handle further including a lever arm extending radially outward from said axle member for engagement within said latch member slot;

a spring positioned with respect to said handle and said body for biasing said handle toward a latched position;

said body further comprising a lock tube formed integrally therewith adjacent said channel to facilitate locking of the latch mechanism, said lock tube being disposed flush with said handle whereby to allow the lock tube to be disposed in a hidden position behind the door if the lock tube is not required;

said latch mechanism comprising no more than three plastic parts; and whereby to facilitate positioning of said latch mechanism closely adjacent one of said longitudinal ends of said door.

17. The latch mechanism of claim 1, wherein only said handle is aesthetically comparable in color to the glove box door, whereby to reduce manufacturing costs.

* * * * *